US009988877B2

(12) United States Patent
Abramova et al.

(10) Patent No.: US 9,988,877 B2
(45) Date of Patent: Jun. 5, 2018

(54) DEVICE FOR CLEANING WATER WELLS

(71) Applicant: VENTORA TECHNOLOGIES AG, Hergiswil (CH)

(72) Inventors: Anna Vladimirovna Abramova, Moscow (RU); Maya Vladimirovna Bayazitova, Moscow (RU); Sergey Andreevich Volchonkov, St.Petersburg (RU)

(73) Assignee: Ventora Technologies AG, Hergiswil, NW (CH)

( * ) Notice: Subject to any disclaimer, the term of this patent is extended or adjusted under 35 U.S.C. 154(b) by 215 days.

(21) Appl. No.: 14/888,031

(22) PCT Filed: Apr. 30, 2013

(86) PCT No.: PCT/RU2013/000376
§ 371 (c)(1),
(2) Date: Oct. 29, 2015

(87) PCT Pub. No.: WO2014/178747
PCT Pub. Date: Nov. 6, 2014

(65) Prior Publication Data
US 2016/0076340 A1 Mar. 17, 2016

(51) Int. Cl.
*E21B 37/00* (2006.01)
*B06B 1/02* (2006.01)
(Continued)

(52) U.S. Cl.
CPC ..... *E21B 37/00* (2013.01); *B06B 1/0207* (2013.01); *B06B 1/0215* (2013.01); *B06B 3/00* (2013.01);
(Continued)

(58) Field of Classification Search
CPC ..... E21B 28/00; E21B 37/00; B06B 1/0215; E03B 3/15
See application file for complete search history.

(56) References Cited

U.S. PATENT DOCUMENTS 3,209,833 A * 10/1965 Sauers ..... E21B 37/00 166/177.6
4,280,557 A * 7/1981 Bodine ..... E21B 37/00 166/177.2
(Continued)

FOREIGN PATENT DOCUMENTS

| | | |
|---|---|---|
| RU | 2392422 | 6/2010 |
| RU | 2446279 | 3/2012 |
| RU | 2471965 | 1/2013 |

OTHER PUBLICATIONS

Colombia Office Action, Columbian Serial No. 15 281345, dated Nov. 25, 2016, 24 pgs.
Translation of International Search report dated Dec. 17, 2013.

*Primary Examiner* — James G Sayre
(74) *Attorney, Agent, or Firm* — Husch Blackwell LLP

(57) ABSTRACT

A device for cleaning water wells comprises a downhole tool composed of an electrohydraulic unit (7) with an oscillatory circuit and an ultrasonic unit (4) with an electroacoustic transducer (3) arranged successively in a single housing, sensors of pressure (10) and flow (11), a hydrophone (12), a pump, an ultrasonic generator (13), a pulse generator (14), monitoring equipment (15) for the sensors, a downhole tool control unit (16) equipped with a synchronizer of operation of the electrohydraulic unit (7) and the ultrasonic unit (4), and also with a device for controlling pulse width, beating frequency and spectrum of the signal of the oscillatory circuit of the electrohydraulic unit in order to change the
(Continued)

treatment zone. Furthermore, a discharge chamber (8) and a protective cap (9) are arranged in the bottom part of the downhole tool.

13 Claims, 4 Drawing Sheets

(51) Int. Cl.
*B06B 3/00* (2006.01)
*E21B 28/00* (2006.01)
*E03B 3/15* (2006.01)

(52) U.S. Cl.
CPC ..... *E03B 3/15* (2013.01); *E21B 28/00* (2013.01); *B06B 2201/71* (2013.01)

(56) References Cited

U.S. PATENT DOCUMENTS 4,314,365 A * 2/1982 Petersen ..... E21B 47/16 175/56
5,004,050 A * 4/1991 Sizonenko ..... E21B 43/003 166/248
5,579,845 A * 12/1996 Jansen ..... E03B 3/15 166/299
6,474,349 B1 * 11/2002 Laker ..... B08B 7/028 134/168 C
8,706,419 B1 * 4/2014 Taylor ..... E03B 3/15 702/11
2001/0011590 A1 * 8/2001 Thomas ..... E21B 28/00 166/248
2004/0095847 A1 * 5/2004 Hassan ..... E21B 47/101 367/25
2005/0269078 A1 * 12/2005 Morgenthaler ..... B08B 3/12 166/249
2008/0033653 A1 * 2/2008 Pabon ..... G01V 1/44 702/6
2012/0043075 A1 * 2/2012 Abramova ..... E21B 43/003 166/249
2017/0016316 A1 * 1/2017 Donzier ..... E21B 17/1078

* cited by examiner

DEVICE FOR CLEANING WATER WELLS

CROSS REFERENCE

This application claims priority to Patent Cooperation Treaty application PCT/RU2013/000376, filed Apr. 30, 2013, the entirety of which is hereby incorporated by reference.

FIELD

The invention relates mainly to a field of water supply and, in particular, can be used to clean water wells.

BACKGROUND

Decrease of yield of water in water wells is usually caused by a blockage of the well. Given that drilling of new wells is a long, expensive process, often coupled with environmental and legal issues, there is a need to clean water wells.

Known is a device for cleaning pipes (U.S. Pat. No. 6,474,349), comprising a mechanical device to create acoustic waves, an electrical power source of high frequency and a source for the polarization of current, wherein the electric current generated by the source is used for excitation or activation of the mechanical device for creating acoustic waves.

Known is a method of oil production using energy of elastic vibrations (RU Patent No. 2,392,422), which can be used for cleaning of water wells is known, the method is selected as the prototype, the method comprises placing a downhole tool in the borehole at a working depth, the downhole tool is connected to a surface power source of commercial frequency and contains an ultrasonic transducer providing generation of elastic vibrations of high frequency, excitation of elastic vibrations of different frequencies and subsequent to this, advantageously repeated exposure of the oil reservoir to elastic vibrations of different frequencies. The method is characterized in that the exposure of the oil reservoir to elastic vibrations is done by vibrations of high and low frequency, the elastic vibrations of high and low frequency are generated by two independent vibration sources, one of which is in the form of at least one radiating ultrasonic advantageously magnetostrictive transducer, and the second is based on an electro-pulse apparatus, which provides generation of the low-frequency elastic vibrations and is connected with a surface power source of commercial frequency, and includes electrically interconnected with each other charger, a unit of storage capacitors, discharge unit, equipped with electrodes, and two switching means, one of which provides a specific arrangement of the storage capacitors into a single unit, and the second one performs the switching of the storage capacitors from one type of electrical connection to the other type, wherein the exposure by the elastic vibrations of high frequencies is performed in the low ultrasonic frequency range, preferably at frequency of 18-44 kHz and is conducted in a continuous and/or a pulsed mode with the intensity within 1 to 5 W/cm$^2$, and the exposure by the elastic vibrations of low frequency is performed at a discharge pulse repetition frequency equal to 0.2-0.01 Hz and is conducted with the energy of a single pulse discharge of 100-800 J, wherein a constant voltage, which value is set within the range 300-150 V is supplied to the charger from the power source, before charging the storage capacitors are arranged into a single unit, the charging of the unit of storage capacitors is carried out advantageously in parallel connection of the capacitors and takes preferably 20 seconds till it is charged to the required voltage value, the maximum value of which shall be equal to 20-27 kV, and before discharge of the unit of the storage capacitors, which ensures the supply of the output voltage to the electrodes of the discharge unit, all the storage capacitors or a certain part of them are switched into a serial electrical connection, the exposure with the elastic vibrations of high and low frequency is performed alternately and/or simultaneously, preferably at a fixed location of the downhole tool, is carried out with permanent and/or with the changing electrical and acoustic characteristics of the surface and/or the downhole equipment and process parameters of oil production, preferably, at a constant and/or periodic production of oil from the well.

The known method and device have a low efficiency of purification of water wells, are complex to manufacture and maintain. The task to be solved by the present invention is to increase the effectiveness of cleaning of water wells.

SUMMARY

A solution to this problem in the present invention is achieved in that the device comprises a downhole tool, comprising successively arranged in the same housing an electrohydraulic unit with an oscillatory circuit, changing the parameters of which the pulse width, beating frequency and spectrum of the signal from the electrohydraulic block can be controlled in order to change the treatment zone, and an ultrasound block with electroacoustic transducers; pressure and flow sensors; a hydrophone; a pump; an ultrasonic and a pulse generators; monitoring equipment for the sensors; a downhole tool control unit equipped with a synchronizer of operation of the electrohydraulic and the ultrasonic units, wherein a discharge chamber and a protective cover are arranged in the bottom part of the housing of the downhole tool.

An aspect of the present disclosure relates to a device for cleaning a water well. The device comprises a downhole tool comprising a housing, an electrohydraulic unit in the housing, including an oscillatory circuit for generating a shockwave, and an ultrasonic unit in the housing above the electrohydraulic unit, comprising one or more electroacoustic transducers for generating an ultrasonic acoustic wave; a downhole tool control unit comprising a synchronizer for synchronizing operation of the electrohydraulic unit and the ultrasonic unit, and a device for controlling the oscillatory circuit to vary a pulse width and the frequency spectrum of the shockwave. The electroacoustic transducers of the ultrasonic unit may be arranged in parallel, or perpendicular-parallel. The electroacoustic transducers of the ultrasonic unit may be arranged in series. The device may comprise a pressure sensor, a flow sensor, and monitoring equipment for the pressure sensor and the flow sensor. The device may comprise an ultrasound generator for supplying an ultrasonic power signal to the ultrasonic unit. The device may comprise a pulse generator for supplying a pulse power signal to the electrohydraulic unit. The electrohydraulic unit may comprise a discharge chamber and a protective cover covering a bottom of the discharge chamber. The ultrasonic unit may comprise a pressure compensator for equalizing a pressure inside the ultrasonic unit and a pressure outside of the ultrasonic unit. The device may comprise a pump for removing clogging material from the water well. The device may comprise a hydrophone.

A further aspect of the present disclosure relates to a method for cleaning a water well. The method comprises generating an ultrasonic acoustic wave to treat a first treatment zone in the water well and generating a shockwave to treat a second treatment zone in the water well; synchronizing generation of the ultrasonic acoustic wave and the shockwave to simultaneously treat the first and second treatment zones and controlling generation of the shockwave to change a frequency spectrum of the shockwave so as to change the second treatment zone; and removing clogging material from the first and second treatment zones. A device disclosed herein may be conveniently used to generate, and control the generation of, the ultrasonic acoustic wave and the shockwave.

DETAILED DESCRIPTION

Figure 4:
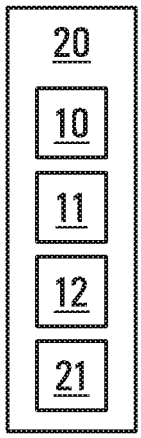
FIG. 4 is a block diagram illustrating schematically components in the upper unit of the downhole part shown in FIG. 2.

The downhole part includes a downhole tool 100 and an upper unit 20 connected to the surface part of the equipment via a logging cable 1. Wherein in the housing of the downhole tool the electrohydraulic unit 7 and the ultrasonic unit 4 with electroacoustic (magnetostrictive) transducers 3 are installed sequentially from the bottom upwards, above the ultrasonic unit the cable lug 2 is arranged and between the electrohydraulic unit 7 and the ultrasonic unit 4 the pressure compensator 5 and the connection unit 6 are arranged. In addition, in the upper unit 20 above the housing of the downhole tool 100, pressure sensors 10, flow sensors 11, a hydrophone 12 and also a pump 21 are installed, as illustrated in FIG. 4. At the bottom part of the downhole tool the discharge chamber 8 and a protective cover 9 are arranged.

Figure 3:
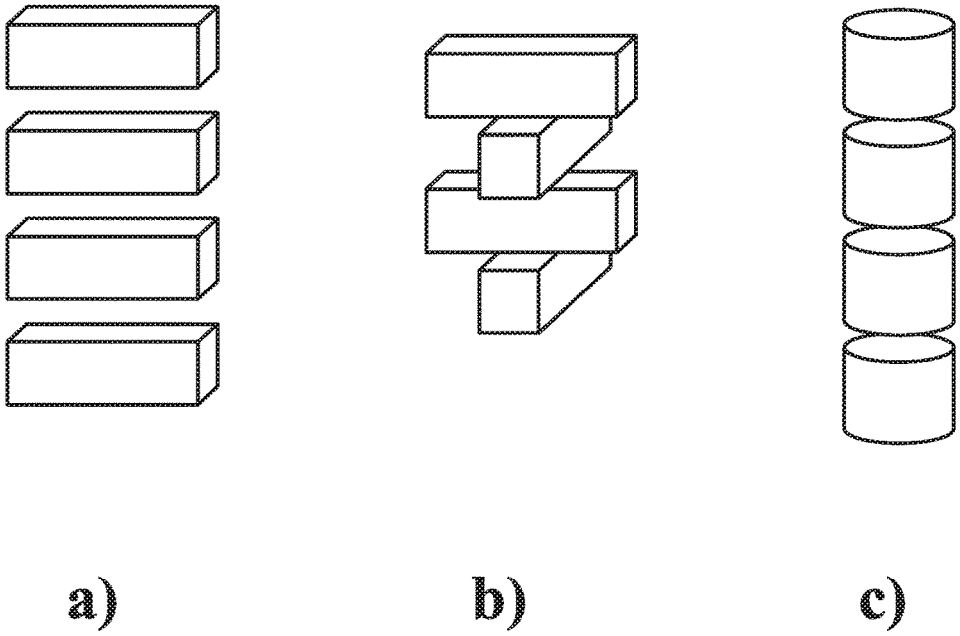
FIG. 3 schematically shows possible arrangements [a), b), and c)] of electroacoustic transducers in an ultrasonic unit.

The electroacoustic transducers 3 mounted in the ultrasonic unit 4 may be installed in parallel (see FIG. 3, a)), perpendicular-parallel (see FIG. 3, b)) or in series (see. FIG. 3, c))—in order to ensure the most effective directivity characteristics corresponding to the conditions of colmatation of the well to be cleaned.

The ultrasonic unit 4 is equipped with a device for pressure compensation 5 (for pressure equalization inside and outside the unit), in order to prevent cavitation within the block. Cable 1 is introduced into the electrohydraulic unit 7 through the ultrasonic unit 4.

This design of the device is optimal to create short discharges inside the well to form an effective shock wave. Combined ultrasound and electrohydraulic treatment can improve the cleaning efficiency of wells, because in this case it has a larger impact area.

The surface part of the device includes: an ultrasonic generator 13 connected via a cable with the ultrasonic unit 4 of the downhole tool; a pulse generator 14 connected via the cable 1 with the electrohydraulic block 7 of the downhole tool; monitoring equipment for the sensors 15 and a signal control unit 16 for the downhole tool with a device 24 for controlling the pulse width, beating frequency and spectrum of the signal of the oscillatory circuit 22 of the electrohydraulic unit 7 and a synchronizer 25 of operation of the ultrasonic generator 13 and the electro-hydraulic unit 7.

Figure 5:
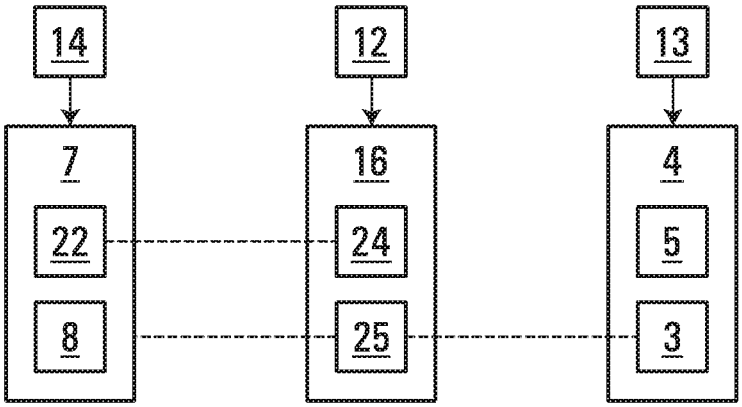
FIG. 5 is a block diagram illustrating schematically relationship and connections between components in the device of FIGS. 1 to 4.

The communication or connection relationship among various components in the device are schematically illustrated in FIG. 5.

Figure 1:
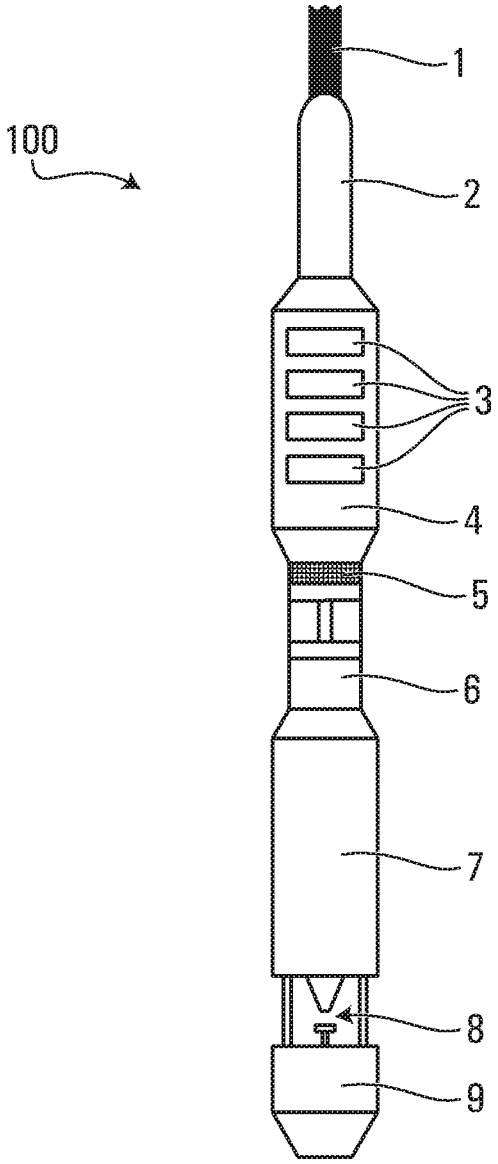
FIG. 1 and FIG. 2 show a diagram of the proposed device. The device consists of a downhole part and a surface part.

The device (see. FIG. 1) works as follows.

Figure 2:
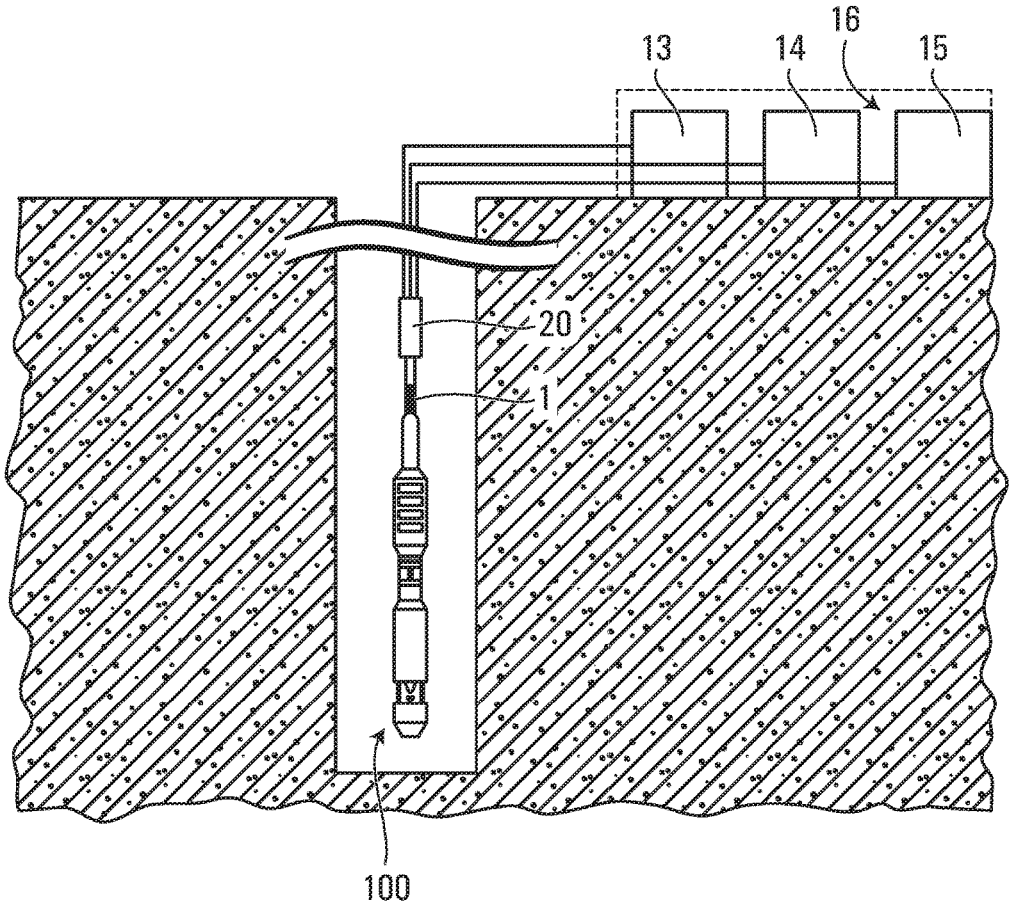

The downhole tool is lowered into the well (see. FIG. 2). With the help of the monitoring unit of the sensors 15 the degree (parameters) of contamination of the well is determined. Then, using the control unit 16, a signal of an appropriate frequency from the ultrasonic generator 13 is supplied through the logging cable 1 to the electroacoustic transducers 3 of the ultrasonic unit 4. Wherein the ultrasonic unit 4 is connected to the surface ultrasonic generator 13 with the following optimal parameters obtained experimentally:

a) frequency range—17-24 kHz;
b) the voltage at the output—420-1200 V;
c) the maximum output power—10 kW;
d) the maximum bias current—15 Å;
d) active cable resistance—20-80 Ohm;
e) Power—3*380 V, 50.60 Hz;
g) Possible change of the supply voltage −10%-+10%;
h) Power consumption—no more than 13.8 kW;
u) the generator can be operated in manual and computer control.

Simultaneously, the signal from the pulse generator 14 is supplied through the geophysical cable 1 to the electrohydraulic unit 7. The signal has the following optimal parameters obtained experimentally:

a) output pulse amplitude—120-240 V;
b) pulse duration—5-50 seconds;
c) the interval between pulses—50-600 seconds;
g) the amplitude of the current pulse—no more than 2.5 A;
d) power supply—220\380 V, 50 Hz;
e) possible change of the supply voltage −10%-+10%;
g) power consumption—no more than 2.3 kW;
h) the generator can work in manual and computer control.

Exposure to the high frequency signal, which is carried out by the ultrasonic unit 4, and a low frequency signal, carried out by the electrohydraulic unit 7, is carried out jointly (synchronously), which leads to a change in the mutual arrangement of the particles in the gravel pack of the wells, whereby the colmatant is removed. Furthermore, changing the configuration of the gravel particles leads to a change in the interference pattern of the ultrasonic waves, and therefore, a shift of the maxima of sonication. This leads to a more thorough cleaning.

The treatment zone of the electrohydraulic unit 7 varies with the parameters of the oscillatory circuit in said unit (inductance, capacitance and resistance). Due to this, it is possible to change the pulse width and its beating frequency, and therefore—the signals spectrum, which leads to a change of the treatment zone. Due to this the exposure is performed for various colmatation zones (predominantly in the filter tube and on the boundary of the gravel pack).

The location of the electrohydraulic unit 7 at the bottom part of the downhole tool enables dual shock front: reflected from the bottom of the well and outgoing from the actual electro-hydraulic unit 7. In this case, the front is a kind of sphere. Experiments have shown that the described combined treatment, carried out by the proposed device, is significantly improves the cleaning performance as compared to single frequency treatment.

Thus, the described device allows effective cleaning of water wells with the smallest possible dimensions of the device.

The invention claimed is:

1. A device for cleaning a water well, comprising:

a downhole tool comprising a housing, an electrohydraulic unit in the housing, including an oscillatory circuit for generating a shockwave, and an ultrasonic unit in the housing above the electrohydraulic unit, comprising one or more electroacoustic transducers for generating an ultrasonic acoustic wave; and a downhole tool control unit comprising a synchronizer for synchronizing operation of the electrohydraulic unit and the ultrasonic unit, and a device for controlling the oscillatory circuit to vary a pulse width and a frequency spectrum of the shockwave so as to change a treatment zone.

2. The device according to claim 1, wherein the electroacoustic transducers of the ultrasonic unit are arranged in parallel.

3. The device according to claim 1, wherein the electroacoustic transducers of the ultrasonic unit are arranged perpendicular-parallel.

4. The device according to claim 1, wherein the electroacoustic transducers of the ultrasonic unit are arranged in series.

5. The device according to claim 1, comprising a pressure sensor, a flow sensor, and monitoring equipment for the pressure sensor and the flow sensor.

6. The device according to claim 1, comprising an ultrasound generator for supplying an ultrasonic power signal to the ultrasonic unit.

7. The device according to claim 1, comprising a pulse generator for supplying a pulse power signal to the electrohydraulic unit.

8. The device according to claim 1, wherein the electrohydraulic unit comprises a discharge chamber and a protective cover covering a bottom of the discharge chamber.

9. The device according to claim 1, wherein the ultrasonic unit comprises a pressure compensator for equalizing a pressure inside the ultrasonic unit and a pressure outside of the ultrasonic unit.

10. The device according to claim 1, further comprising a pump for removing clogging material from the water well.

11. The device according to claim 1, further comprising a hydrophone.

12. A method for cleaning a water well, comprising:

generating an ultrasonic acoustic wave to treat a first treatment zone in the water well and generating a shockwave to treat a second treatment zone in the water well;

synchronizing generation of the ultrasonic acoustic wave and the shockwave to simultaneously treat the first and second treatment zones, and controlling generation of the shockwave to change a frequency spectrum of the shockwave so as to change the second treatment zone; and removing clogging material from the first and second treatment zones.

13. The method of claim 12, comprising using the device of claim 5 to generate, and control the generation of, the ultrasonic acoustic wave and the shockwave.

* * * * *